US012736001B2

(12) United States Patent
El Hor et al.

(10) Patent No.: US 12,736,001 B2
(45) Date of Patent: Sep. 15, 2026

(54) METHOD FOR POSITIVE CRANKSHAFT VENTILATION DIAGNOSIS

(71) Applicant: DELPHI TECHNOLOGIES IP LIMITED, Belleville (BB)

(72) Inventors: Noureddine El Hor, Vineuil (FR); Davy Decorps, Olivet (FR)

(73) Assignee: PHINIA DELPHI LUXEMBOURG SARL, Belvaux (LU)

( * ) Notice: Subject to any disclaimer, the term of this patent is extended or adjusted under 35 U.S.C. 154(b) by 131 days.

(21) Appl. No.: 18/571,854

(22) PCT Filed: Sep. 19, 2022

(86) PCT No.: PCT/EP2022/075892
§ 371 (c)(1),
(2) Date: Dec. 19, 2023

(87) PCT Pub. No.: WO2023/041760
PCT Pub. Date: Mar. 23, 2023

(65) Prior Publication Data

US 2024/0229692 A1 Jul. 11, 2024

(30) Foreign Application Priority Data

Sep. 20, 2021 (GB) ..... 2113392

(51) Int. Cl.
*F01M 11/10* (2006.01)

(52) U.S. Cl.
CPC ..... *F01M 11/10* (2013.01); *F01M 2250/60* (2013.01)

(58) Field of Classification Search
CPC ..... F01M 11/10
See application file for complete search history.

(56) References Cited

U.S. PATENT DOCUMENTS

2010/0147270 A1 6/2010 Pursifull et al.
2013/0073174 A1* 3/2013 Worden ..... F02D 41/22 73/114.16

(Continued)

FOREIGN PATENT DOCUMENTS

WO 2020152238 A1 7/2020

OTHER PUBLICATIONS

International Search Report for PCT/EP2022/075892 dated Jan. 11, 2023, 4 pages.

*Primary Examiner* — Christian Chace
*Assistant Examiner* — Minato Lee Horner
(74) *Attorney, Agent, or Firm* — WARNER NORCROSS + JUDD LLP

(57) ABSTRACT

A method for positive crankcase ventilation diagnosis in an engine system with an engine, an intake duct connected to the engine, a PCV line connecting a crankcase of the engine with the intake duct and a sensor for determining an actual PCV pressure ($p_{act}$) in the PCV line. The method comprises the steps of:

performing a diagnosis measurement by repeatedly determining at least one input parameter ($p_{int}$, $n_e$, $p_{atm}$, Q), which is linked to the operation of the engine system, and the actual PCV pressure ($p_{act}$), to obtain a plurality of data samples for a plurality of sample times ($t_s$);

using a prediction model (M) to determine a predicted PCV pressure ($p_{pre}$); and comparing the actual PCV pressure ($p_{act}$) with the predicted PCV pressure ($p_{pre}$) to diagnose the PCV line, wherein a diagnosis of the PCV line is based on a model error ($p_{err}$).

15 Claims, 3 Drawing Sheets

(56) References Cited

U.S. PATENT DOCUMENTS

| | | | | |
|---|---|---|---|---|
| 2016/0097355 | A1 | 4/2016 | Jentz et al. | |
| 2016/0195449 | A1 | 7/2016 | Haslbeck et al. | |
| 2019/0184816 | A1* | 6/2019 | Chaussinand | G01N 7/14 |
| 2019/0304214 | A1* | 10/2019 | Mentele | G07C 5/0825 |
| 2020/0256223 | A1 | 8/2020 | Sekiguchi et al. | |
| 2020/0263625 | A1* | 8/2020 | Yamane | F02M 26/47 |
| 2020/0400050 | A1* | 12/2020 | Jentz | G01M 3/025 |
| 2021/0348532 | A1* | 11/2021 | Holzeder | F01M 11/10 |

* cited by examiner

METHOD FOR POSITIVE CRANKSHAFT VENTILATION DIAGNOSIS

CROSS-REFERENCE TO RELATED APPLICATIONS

This application is the U.S. National Stage of International Application No. PCT/EP2022/075892 filed on 19 Sep. 2022, which claims priority to and all advantages of United Kingdom Application No. 2113392.1 filed on 20 Sep. 2021, the contents of which are incorporated herein by reference.

TECHNICAL FIELD

The invention relates to a method for positive crankcase ventilation diagnosis and to a diagnosis unit.

BACKGROUND ART

In an internal combustion engine, an air-fuel-mixture is ignited and burnt inside a combustion chamber of a cylinder. The combustion gases are then vented through an exhaust duct, before fresh air is introduced into the combustion chamber, fuel is—directly or indirectly—injected, and the next combustion is effected. Ideally, the combustion gases should be vented entirely through the exhaust port. However, in reality, it can hardly be avoided that combustion gases, also referred to as "blow-by gases", leak into the crankcase. In principle, these gases could be vented to the outside atmosphere, but this is not favorable under environmental aspects. So-called positive crankcase ventilation (PCV) recirculates the blow-by gases into the intake duct. This utilizes the underpressure in the intake duct to suck the gases out of the crankcase through a PCV line, which may comprise a non-return valve to prevent backflow into the crankcase. Also, a pressure sensor can be disposed to detect pressure inside the PCV line. In some cases, a controllable valve is used to regulate this pressure.

The PCV line connecting the crankcase and the intake duct can be established by any suitable piping. Often, a flexible hose or the like is used, which makes it easy to establish a connection irrespective of the geometry and relative position of the engine and the intake duct. However, especially after long usage, such hoses can become porous, can contain major holes, or even become completely disconnected. In such a case, considerable amounts of blow-by gases could leak to the outside atmosphere, thereby nullifying the benefits of PCV. Current and future emission regulations therefore demand that at least major leaks, and in particular a complete disconnection, can be detected. To this effect, various approaches have been developed to detect leakage in a PCV system. However, many of these are either not reliable or require additional components that increase material and installation costs. In particular, it is known to monitor the pressure in the PCV line and compare it to a predefined threshold. Thus, a complete disconnection can be detected reliably, but smaller leaks often remain undetected.

Technical Problem

It is thus an object of the present invention to provide reliable, cost-effective means for detecting leakage in a positive crankcase ventilation system.

This problem is solved by a method according to claim 1 and by a diagnosis unit according to claim 15.

GENERAL DESCRIPTION OF THE INVENTION

The invention provides a method for positive crankcase ventilation diagnosis in an engine system with an engine, an intake duct connected to the engine, a PCV line connecting a crankcase of the engine with the intake duct and a sensor for determining an actual PCV pressure in the PCV line. One could also say that the invention provides a positive crankcase ventilation diagnosis method, or PCV diagnosis method. The method is performed on an engine system, wherein the term "engine system" indicates that the system comprises several components, one of which is an internal combustion engine, which may be of any type, e.g., a gasoline or diesel engine, or operating on other fuels, and may be charged or uncharged. It can in particular be an engine of an automotive vehicle like a car. The inlet duct, which may also be an inlet manifold or comprise an inlet manifold, is disposed upstream of a combustion chamber of the engine and is adapted to supply air to the combustion chamber. It will be understood that the intake duct can be connected to a compressor of a turbocharger or may comprise such a compressor. A crankcase of the engine is connected with the intake duct by a PCV line. In general, the PCV line could be any vessel that is adapted for transferring gas from the crankcase to the intake duct, e.g., a rigid pipe, a flexible hose, or a combination of these. The PCV line is used to perform positive crankcase ventilation, i.e., to extract blow-by gases from the crankcase by applying a relative underpressure. In other words, the pressure on the intake-duct side of the PCV line should be below the pressure on the crankcase side.

During operation of an uncharged engine, the pressure in the intake duct is normally below atmospheric pressure. In case of a charged engine, the pressure upstream of the compressor is normally below atmospheric pressure, wherefore the PCV line is connected upstream of the compressor. In all of these cases, a decreased pressure in the intake duct facilitates extraction of blow-by gases from the crankcase. The engine system further comprises a sensor for determining an actual (current) PCV pressure in the PCV line. The sensor is normally a pressure sensor for measuring the actual PCV pressure, but it is within the scope of the invention that the actual PCV pressure may not be measured directly but is derived from another quantity measured by the sensor. Of course, pressure is normally not constant in the entire PCV line but there will be a pressure gradient. In case of a pressure sensor, the location of this pressure sensor in the PCV line is not restricted by the invention. Normally, though, it will be disposed at the crankcase side of the PCV line, or at least closer to the crankcase side than to the intake-duct side.

According to one step of the inventive method, a diagnosis measurement is performed during a measurement period by repeatedly determining at least one input parameter, which is linked to the operation of the engine system, and the PCV pressure, to obtain a plurality of data samples for a plurality of sample times. The respective input parameter can also be referred to as an input parameter of the engine system. It is linked to the operation of the engine system, i.e., it is either characteristic of the current operation of the engine system as such or it has an influence on the operation of the engine system. The input parameter can be measured by an appropriate sensor, or it could be determined otherwise, e.g., by deducing the input parameter from measurement of at least one other quantity (measured or estimated). As will become apparent below, it is normal that a plurality of input parameters is determined. The at least one input parameter and the PCV pressure are determined repeatedly during a measurement period, wherein the term "repeatedly" also includes the possibility that each quantity is determined or measured continuously or quasi-continuously during this measurement period. Either way, a plurality of data samples is obtained for a plurality of sample times within the entire measurement period. The number of data samples for the PCV pressure is normally the same as for each input parameter but could also be different. Normally, a data sample for a sample time corresponds to the at least one input parameter and the actual PCV pressure determined for this sample time. Each data sample is normally stored at least temporarily in a suitable memory device. It should be noted that the term "measurement period" does not imply that this has to be a single, coherent time interval. It is also possible that the measurement period is composed of a plurality of separate time intervals.

In another step of the method, a prediction model is used to determine a predicted PCV pressure based on the determined at least one input parameter. The prediction model represents a connection between the at least one input parameter and the PCV pressure. One could also say that the prediction model is based on the assumption that there is some causality between the at least one input parameter and the PCV pressure, wherefore it is possible to predict the PCV pressure based on the input parameter(s). It should be noted that the predicted PCV pressure at a given point in time may not only depend on the input parameter(s) for this point in time, but also before this point in time, i.e., on input parameters "of the past". As a rule, the prediction model represents an intact engine system, i.e., the prediction model is based on the assumption that the engine system is intact. Normally, this step is performed after the end of the measurement period, but it is within the scope of the invention that it is performed (or at least started) during the measurement period, e.g., as soon as a sufficient number of samples exist for the at least one input parameter.

As used herein, the term "intact" designates a normally operating or fully working system or component. An "intact PCV line", i.e., with no holes, is thus to be regarded as fully working in the context of the present diagnostic.

In another step of the method, the actual PCV pressure is compared with the predicted PCV pressure to diagnose the PCV line. Diagnosing the PCV line in this context normally refers to assessing integrity of the PCV line or performing a leak detection in the PCV line. As mentioned above, the prediction model normally represents an engine system with an intact PCV line having no leaks and being properly connected. Here and in the following, a disconnected portion of the PCV line is also considered as a leak. As long as the predicted pressure is obtained from a prediction model that represents an intact engine system, the actual PCV pressure should be identical or at least similar to the predicted PCV pressure if the PCV line is intact (assuming that the prediction model is accurate enough). Accordingly, diagnosis of the PCV line can be performed by comparing the actual PCV pressure with the predicted PCV pressure. "Comparing" in this context can also be based on calculating the difference between the actual PCV pressure and the predicted PCV pressure. It should be noted that the step of diagnosing the PCV line is normally performed after the measurement period and also after the predicted PCV pressure has been determined for all data samples (or at least for all data samples that are taken into account). In other words, the diagnosis is normally only performed when all relevant data are available. However, the diagnosis could at least be started as soon as at least a single value for the predicted PCV pressure has been determined and can be compared to the corresponding measured PCV pressure.

In practice, a diagnosis status, e.g., pass or fail, may thus be determined based on the comparison of the actual PCV pressure with the predicted PCV pressure. Alternatively or complementarily, an alert (visual and/or audio) may be triggered based on the result of the comparison of the actual PCV pressure with the predicted PCV pressure. The method may thus be implemented from time to time as part of the on-board diagnostics, the comparison of the actual PCV pressure with the predicted PCV pressure being used to determine a status of the PCV line, such as intact/pass or faulty, fail, damaged . . . . Typically, at least the case of faulty status leads to the triggering of an alert within the ECU and/or to the driver.

According to the invention, a diagnosis of the PCV line is based on a model error which is the difference between the predicted PCV pressure and the actual PCV pressure, wherein the model error being below a lower threshold is considered to indicate that the PCV line is intact, the model error being above an upper threshold is considered to indicate that the PCV line is damaged, and the model error being between the lower threshold and the upper threshold is considered as an inconclusive result.

It should be noted that the model error is normally not a single value but is generally different for different sample times. In other words, like the predicted PCV pressure the actual PCV pressure, the model error is a function of time. The term "model error" indicates that this is an error of the prediction made by the model with respect to the actual measurement. Of course, the diagnosis assumes that there is no "error" in the model as such, but that any significant discrepancy between the predicted PCV pressure and the actual PCV pressure is due to the (false) assumption that the PCV line was intact. The diagnosis is "based on" the model error, which includes the possibility that the model error itself is used as well as the possibility that the model error is further processed or modified before the diagnosis is performed.

Specifically, the model error being below a lower threshold is considered to indicate that the PCV line is intact. Ideally, the model error could be zero if the PCV line is completely intact (as in the intact engine system), but normally there is at least a minor model error. The lower threshold can be chosen sufficiently high to ensure that an actually intact PCV line is recognized as such. It will be understood that the terms "lower threshold" and "below" refer to a definition of the model error where any (considerable) leak in the PCV line leads to a positive model error.

Although the PCV line could be considered damaged whenever the model error is above the lower threshold, it may not always be possible to clearly separate an intact PCV line from a damaged PCV line by a single threshold. More often than not, there is a "grey area" where the PCV line might or might not be intact. Therefore, according to the invention, the model error being above an upper threshold is considered to indicate that the PCV line is damaged, and the model error being between the lower threshold and the upper threshold is considered as an inconclusive result. Of course, the upper threshold is above the lower threshold. The interval between the upper and the lower threshold can be considered as a "grey area" where the model error does not allow for a reliable assessment. Accordingly, the analysis is considered inconclusive if the model error is between these two thresholds. Those sample times where the model error leads to such an inconclusive analysis are basically disregarded. It has been found, though, that if some samples are between the upper and lower threshold, there is normally a sufficient amount of remaining samples that can be taken into account. The invention is based on the following ideas: first, the actual PCV pressure in the PCV line depends on the at least one input parameter, i.e., there is a causal relationship between the at least one input parameter and the PCV pressure. Second, the causal relationship depends on the integrity of the PCV line. Accordingly, a predicted PCV pressure based on the assumption that the PCV line is in a certain state (normally, an intact state) should agree more or less with the actual PCV pressure if the PCV line is actually in this state. However, if the PCV line is assumed to be intact, but in fact has at least one leak, a discrepancy between the predicted PCV pressure and the actual PCV pressure should occur, which can be expressed by the model error. Moreover, due to various factors, there is oftentimes a certain "grey area" in which the model error does not indicate clearly whether the PCV line is intact or damaged. The reliability of the diagnosis is improved considerably if data samples from this grey area are excluded as inconclusive.

It should be noted that the inventive method enables PCV diagnosis while requiring no or only few additional sensors. As will be discussed below, the at least one input parameter can be determined based on sensors that are common in a modern vehicle. Also, the pressure sensor for measuring the PCV pressure is a common component in an engine system that is adapted for PCV. Accordingly, the inventive method can be performed on many engine systems with no or little adaptations. The abovementioned steps of the method can be performed by an inventive diagnosis unit, which may at least partially be integrated into a vehicle that comprises the engine system or may be an external device that is connected temporarily to the engine system.

A preferred embodiment provides that the diagnosis is based on a comparison between a first number of sample times with a model error indicating that the PCV line is intact and a second number of sample times with a model error indicating that the PCV line is damaged. Instead of a first/second number of sample times, one could also refer to a first/second number of data samples. It will be understood that the model error is a function of time and one can determine a model error for every sample time. Accordingly, the model error may, e.g., be above the upper threshold for one sample time while it is between the two thresholds for another sample time. If all sample times are considered for which the model error is not between the thresholds (and that optionally fulfill other criteria, like the enabling condition(s) mentioned below), it has been found that a clear majority (or even all) of the model errors are either below the lower threshold (indicating an intact PCV line) or above the upper threshold (indicating indicating a damaged PCV line). Accordingly, an unambiguous diagnosis result can be obtained, by comparing the first number with the second number. In some cases, one of the first number and the second number can be zero. If none of the numbers is zero, different criteria can be found for the diagnosis result. E.g., the result can depend on whichever number is greater than the other. However, to avoid unreliable results, the criterion could include that one number is greater than the other number by a certain ratio, e.g., at least twice as large.

Mostly, the model needs to be adapted to a certain type of engine system, e.g., to a certain car model and variant. It is thus preferred that the method comprises additional steps, which are performed before the diagnosis measurement. In one step at least one set-up measurement is performed by determining the PCV pressure and the at least one input parameter in an intact engine system. The intact engine system comprises the same components as the engine system that is diagnosed later. More specifically, the respective components are normally identical. In any case, the intact engine system is undamaged, which particularly pertains to the PCV line. I.e., this PCV line has no leaks and is properly connected to the crankcase and the intake duct. The intact engine system can be expected to show an "ideal" behavior, in particular an ideal dependency of the PCV pressure on the at least one input parameter. A plurality of set-up measurements can be performed, using a single intact engine system or a plurality of intact engine systems. It will be understood that the intact engine system should undergo various operation conditions, e.g., corresponding to a standardized drive cycle like WLTC, RDE or FTP. The duration of a set-up measurement could be as long as that of a diagnosis measurement, or it could be longer or shorter. Again, "determining" mostly refers to direct measurement of the respective quantity, but could also refer to indirectly deriving the quantity from measurement of at least one different quantity. Anyway, determining the PCV pressure and the at least one input parameter allow to deduce the dependency of these quantities, which is the basis for the prediction model. Accordingly, in another step, the prediction model is determined at least partially based on the at least one set-up measurement. "At least partially" means that some aspects of the prediction model could be independent of the set-up measurement. For instance, the model could be based on a "response function" that describes the time development of the PCV pressure in response to the input parameter(s). A parameterized "prototype" function could be assumed for the response function and several parameters of this function could be "fitted" to the measured data. It should also be noted that not all data from the set-up measurement needs to be used for determining the prediction model. Performing the diagnosis measurement(s), determining the predicted PCV pressure and diagnosing the PCV line can performed by a diagnosis unit on board a vehicle that comprises the engine system. However, performing the set-up measurement(s) and determining the prediction model are, as a rule, performed by a different unit, which may also be referred to as a set-up unit. Moreover, two different units could be used for the set-up measurement on the one hand, and for determining the prediction model on the other hand. For the most part, determining the prediction model requires considerable computing power that may not be readily available on board the vehicle. The prediction model determined by the set-up unit can then be transferred to the diagnosis unit (or to a plurality of diagnosis units, each of which is installed in a vehicle). The diagnosis unit and the set-up unit can be regarded as parts of an inventive diagnosis system.

As a rule, at least one set-up measurement is performed during a set-up period by repeatedly determining the actual PCV pressure and the at least one input parameter in an intact engine system, to obtain a plurality of set-up data samples for a plurality of set-up sample times. The at least one input parameter and the PCV pressure are determined repeatedly during a set-up period. A plurality of set-up data samples is obtained for a plurality of set-up sample times within the entire set-up period. Uke the data samples of the measurement period, a set-up data sample for a set-up sample time usually corresponds to the at least one input parameter and the actual PCV pressure determined for this set-up sample time. Each set-up data sample is normally stored at least temporarily in a suitable memory device. Again, the term "set-up period" does not imply that this has to be a single, coherent time interval. It is also possible that the set-up period is composed of a plurality of separate time intervals.

Normally, at least one input parameter changes during at least one set-up measurement. This is the case, e.g. for the abovementioned standardized drive cycles. However, other operating conditions with changing input parameters are conceivable, too. For one, several, or all input parameters, a certain parameter range can thus be covered during the set-up measurement(s). Accordingly, at least one input parameter will be different for different set-up data samples.

According to a preferred embodiment, the model is determined by a machine learning technique. With this approach, which uses a form of artificial intelligence, a computer can continuously improve the model (e.g., represented by an algorithm) as more and more data samples are analyzed. In other words, the structure of the model and the underlying algorithm are not provided by a human (e.g., a programmer), but they can be established by the computer as it learns from the data. It will be understood that this allows a high degree of flexibility and makes it possible to adapt the model to all kinds of engine systems, e.g., corresponding to different car models and variants, different engine types (gasoline, diesel etc.) as well as charged or uncharged engines. Since the human influence on the creation of the prediction model is eliminated entirely or for the most part, possibly false assumptions on the basic dependency of the PCV pressure on the input parameter(s) cannot influence the model. Of course, it also relieves the human from finding out the basic structure of this dependency. By way of example, a feed-forward, dual layer network can be used as the basic structure of the model. This basic structure can be selected by a human. While determining the prediction model, various network parameters can be adapted or "tuned" by a computer (as part of the set-up unit) during an automated optimization algorithm, during which it is not possible to make manual changes.

The prediction model may in particular be determined based on a neural network trained with set-up data samples corresponding to at least one set-up measurement, in which the actual PCV pressure and the at least one input parameter in an intact engine system have been determined. This embodiment does not specifically require that the at least one set-up measurement is performed as part of the method. Instead, the set-up data samples used for training the neural network could be the results of a set-up measurement that has been performed before the start of the method, e.g., by a different unit, in a different location and/or a long time before.

The diagnosis result depends on a correct determination of the actual PCV pressure. To this respect, any drift or other offset in the data from the (pressure) sensor could potentially lead to false diagnosis results. It is therefore preferred that a calibration is performed for the actual PCV pressure. This means that the sensor used to determine the PCV pressure is calibrated. Since this is normally a pressure sensor in the PCV line, it can easily be calibrated while the engine is off, in which case the actual PCV pressure should be equal to atmospheric pressure (ambient pressure).

In general, the inventive method is not restricted to any particular choice of input parameter. Normally, though, at least one input parameter is selected from among an engine speed, an intake pressure, an intake gas flow, a coolant temperature of a cooling system of the engine, and a throttle position of a throttle in the intake duct. In particular, several or all five of these quantities can be used as input parameters. To be precise, if the engine is a charged engine, the intake pressure is measured downstream of a compressor, and may also be referred to as a boost pressure. It will be understood that in the intact engine system, the intake pressure greatly influences extraction of blow-by gas through the PCV line. This, on the other hand, also depends on the intake gas flow, which could also be referred to as an intake air flow (although the air will be mixed with blow-by gas from the PCV line), an intake mass flow or an intake volume flow, respectively. Moreover, the engine speed, apart from influencing the intake pressure and the intake gas flow, has an influence on the production of blow-by gases, thereby directly influencing the PCV pressure. The coolant temperature indicates the overall temperature of the engine. This influences oil viscosity and can e.g., have an influence of the quantity of blow-by gases that manage to pass through the piston sealing rings. Although the intake gas flow is at least partially correlated with the throttle position, considering both parameters is not completely redundant, e.g., because they generally have different response times. Other input parameters can be used in addition to the above-mentioned five quantities or, possibly, instead of at least one of these quantities. Possible choices include an atmospheric pressure, an intake air temperature, or a gradient of the intake pressure, the engine speed and/or the intake gas flow. Of course, the gradient (or more precisely, the time derivative) of a quantity can be calculated from the time evolution of the quantity itself. Furthermore, an EGR flap position (if the engine system has an EGR system) or an actuator position of a variable-geometry turbocharger (if present in the engine system) can be used as an input parameter. Additionally, characteristics of the PCV pressure itself can be used as input parameters. For instance, a signal amplitude of the measured PCV pressure may contain information on the integrity of the PCV line. Generally, oscillations or changes of the measured PCV pressure are greater if the PCV line is intact. Apart from the amplitude as such, the lower (e.g., first and/or second) harmonics of the PCV pressure can be used as an input parameter.

It has been found beneficial if an actual PCV pressure of a sample time in the measurement period is only used for the diagnosis if at least one enabling condition is fulfilled for this sample time, and is disregarded otherwise. In other words, there is at least one predefined enabling condition that has to be fulfilled for the sample time that the actual PCV pressure represents, normally the sample time at which the actual PCV pressure is measured. If the at least one enabling condition is fulfilled for this sample time, the PCV pressure is included in the diagnosis, otherwise it is not taken into account. One could say that a kind of "data filtering" or "data selection" is performed. It has been found that if the at least one enabling condition is chosen properly, such data filtering greatly helps to identify any leakage in the PCV line while at the same time avoiding false identification of such leakage.

One enabling condition can be that the engine speed is above a predefined minimum speed. It has been found that data samples corresponding to a relatively low engine speed often lead to inconclusive or false results. It is therefore beneficial to ignore any data from a sample time at which the engine speed is below a minimum speed. By way of example, this minimum speed could be between 2000 and 3000 rpm, but generally depends on the respective engine system and engine. It should also be noted that for a given engine, there is not one specific, correct minimum speed, but different values could be chosen. Choosing a higher value generally minimizes the risk of impairing the diagnosis result, while choosing a lower value increases the sample size on which the diagnosis is based.

Alternatively or additionally, one enabling condition can be that the difference between the intake pressure and atmospheric pressure is above a predefined minimum pressure. It will be understood that the intake pressure corresponds to atmospheric pressure when the engine is turned off, but differs from ambient pressure during operation of the engine. By way of example, the above-mentioned minimum pressure could be 0.15 bar. As for the minimum speed mentioned above, the choice of the minimum/maximum pressure generally depends on the individual engine system and even for a given engine system, the choice is not unambiguous.

Also, one enabling condition may be that the intake gas flow is above a predefined minimum flow. If the intake gas flow is low, the flow through the PCV line will also be low, even for an intact system. Accordingly, it will be difficult to distinguish an intact system from a damaged system under these conditions.

Another possible enabling condition is that an atmospheric pressure is above a predefined minimum pressure. The atmospheric pressure is the ambient pressure around the engine system, i.e., normally around a vehicle that comprises the engine system. It has been found that under low ambient pressure, i.e., at high altitude, the diagnosis results may be detrimentally affected.

Another enabling condition can be that a predefined first delay time has passed since a transient period of at least one input parameter. In particular, this may be a transient period of the intake pressure. In this context, there are various possible definitions of a "transient period", but all of them refer to a time during which the input parameter changes (significantly). Under certain circumstances, time periods in which the input parameter changes at a low rate could be excluded from the definition, as well as time periods in which the total change of the input parameter is only minor. Normally, the entire engine system and in particular the PCV line need some time to reach a quasi-stable state. The behavior of the engine system during and immediately after the transient period can be unpredictable to some extent and therefore inclusion of the corresponding data may have a detrimental influence on the analysis. If at least the first delay time has passed between the transient period and the sample time, the corresponding actual PCV pressure can be used.

The at least one enabling condition may be checked only for the sample time. Alternatively, it is possible that the actual PCV pressure is only used if the at least one enabling condition has been fulfilled for a predefined second delay time before the sample time. In other words, each enabling condition has to be fulfilled for the sample time and for all times before it up to a second delay time. E.g., if the second delay time is 800 ms, and the sample time is 10.1 s, the enabling condition has to be fulfilled for the time interval from 9.3 s to 10.1 s. While reference is made to a "first" and "second" delay time, this does not exclude the possibility that these delay times may have the same value.

In some cases, it can be beneficial if a low-pass filter is applied to at least one input parameter. This may in particular pertain to the intake pressure. The low-pass filter at least partially removes higher frequency components from the input parameter as a function of time. A reliable diagnosis is possible and may even be facilitated if higher frequency components are removed. Normally, an identical low-pass filter is used for the set-up measurements (and thus for determining the prediction model) as for the diagnosis measurements (and thus for the diagnosis).

According to one option, a low-pass filter is applied to the model error before the diagnosis. In general, the model error as a function of time contains components of different frequencies, with the relevant frequencies mostly being the engine frequency and its integer multiples. It has been found that reliable diagnosis is possible and even facilitated if higher frequency components are removed from the model error. In other words, a low-pass filter is applied to the model error, thereby obtaining a "modified" or "filtered" model error.

The invention also provides a diagnosis unit for positive crankcase ventilation diagnosis in an engine system with an engine, an intake duct connected to the engine, a PCV line connecting a crankcase of the engine with the intake duct and a sensor for determining an actual PCV pressure in the PCV line. According to invention, the diagnosis unit is adapted to:

perform a diagnosis measurement during a measurement period by repeatedly determining at least one input parameter, which is linked to the operation of the engine system, and the actual PCV pressure, to obtain a plurality of data samples for a plurality of sample times;

use a prediction model to determine a predicted PCV pressure based on the determined at least one input parameter; and compare the actual PCV pressure with the predicted PCV pressure to diagnose the PCV line, wherein a diagnosis of the PCV line is based on a model error, which is the difference between the predicted PCV pressure and the actual PCV pressure, wherein the model error being below a lower threshold is considered to indicate that the PCV line is intact, the model error being above an upper threshold is considered to indicate that the PCV line is damaged, and the model error being between the lower threshold and the upper threshold is considered as an inconclusive result.

It will be understood that the diagnosis unit can at least partially be integrated into the engine system or into a vehicle that comprises the engine system. The diagnosis unit can be connected to the sensor for determining the actual PCV pressure, as well as to possible additional sensors for determining the at least one input parameter. Of course, the diagnosis unit may be part of an engine control unit (ECU). The diagnosis unit, respectively ECU, typically integrate a microprocessor and are computer-like devices. The above-described functions of the method and diagnosis unit are typically implemented at least partially by software (program code instructions). It may be noted that the present method can generally be regarded as a computer implemented method.

All of the other terms have already been explained above with respect to the inventive method and therefore will not be explained again. Preferred embodiments of the inventive diagnosis unit correspond to those of the inventive method. As explained above, the embodiments referring to determining the prediction model normally require a set-up unit that is distinct from the diagnose unit and is not installed in the vehicle. In such a case, the set-up unit and the diagnosis unit can be regarded as parts of a diagnosis system.

BRIEF DESCRIPTION OF THE DRAWINGS

Preferred embodiments of the invention will now be described, by way of example, with reference to the accompanying drawings, in which.

DESCRIPTION OF PREFERRED EMBODIMENTS

Figure 1:
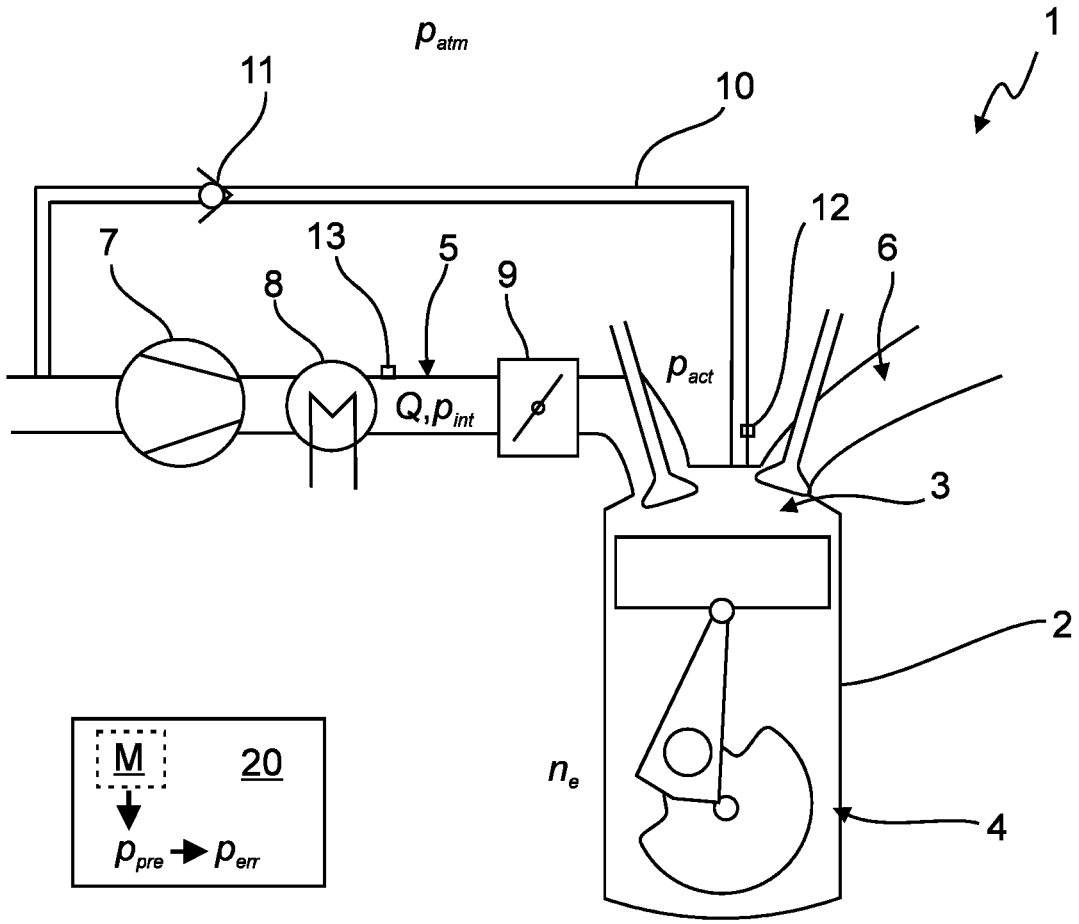
FIG. 1 is a principle diagram of an engine system and an inventive diagnosis unit.

FIG. 1 shows a principle diagram of an engine system 1 of a vehicle and an inventive diagnosis unit 20. The engine system 1 comprises an internal combustion engine 2, e.g., a turbocharged gasoline engine. It will be understood that the engine 2 normally has a plurality of cylinders, of which only one is shown in this representation. A combustion chamber 3 is connected to an intake duct 5 and an exhaust duct 6, each of which can be temporarily isolated from the combustion chamber 3 by an intake valve or exhaust valve, respectively. During the combustion cycle, air is taken in through the intake duct 5 into the combustion chamber 3 and fuel, e.g., gasoline, is injected. Afterwards, the combustion is initiated, and the exhaust gases are expelled through the exhaust duct 6. However, a portion of the exhaust gases escaped from the combustion chamber 3 past the cylinder and into a crankcase 4 of the engine 2. These blow-by gases need to be vented from the crankcase 4 via a PCV line 10, which comprises a non-return valve 11 to prevent backflow into the crankcase 4. The PCV line 10 is connected to the crankcase 4 and to the intake duct 5 upstream of a compressor 7 that is part of a turbocharger. Downstream of the compressor 7, a charge-air cooler 8 and a throttle 9 are disposed on the intake duct 5. A first pressure sensor 12 is disposed in the PCV line 10 to measure an actual PCV pressure pa, while a second pressure sensor 13 is disposed on the intake duct 5 to measure an intake pressure $p_{int}$, which may also be referred to as a boost pressure. An intake gas flow Q inside the intake duct 5 can also be measured by a suitable sensor (like a moving vane meter or hot wire sensor) that is not shown for sake of simplicity.

FIG. 1 also shows a schematic representation of a diagnosis unit 20 which may be integrated in the vehicle. The diagnosis unit 20 is adapted to perform a diagnosis of the engine system 1 or, more specifically, of the PCV line 10. To this end, a prediction model M is implemented in the diagnosis unit 20. Based on this prediction model M, the diagnosis unit 20 can determine a predicted PCV pressure $p_{pre}$ based on several input parameters. In the present case, these input parameters include an engine speed $n_e$, of the engine 2, the intake pressure $p_{int}$, the intake gas flow Q, a coolant temperature, and a position of the throttle 9.

Figure 2:
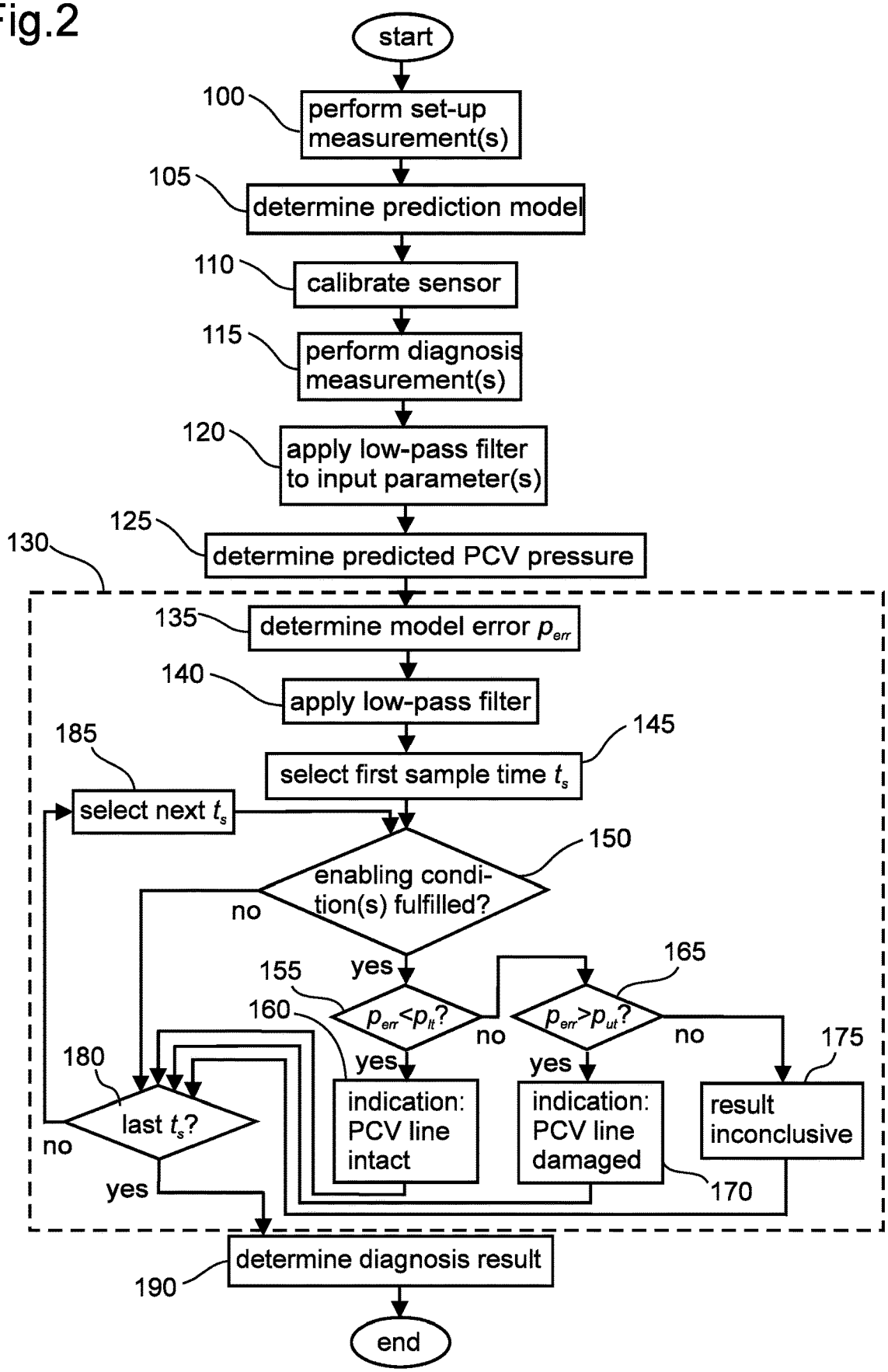
FIG. 2 is a flowchart of an inventive method.

FIG. 2 is a flow diagram illustrating an embodiment of the inventive method. After the start, the prediction model M needs to be determined. To this end, at least one set-up measurement is performed at step 100. For each set-up measurement, the time evolution of the actual PCV pressure $p_{act}$ and all input parameters $n_e$, $p_{int}$, Q is measured using an intact engine system. This is identical to the engine system 1 shown in FIG. 1, except for that integrity of the PCV line 10 is known in the intact engine system. The at least one set-up measurement is performed during a set-up period that may have a length of several minutes or even hours. With the set-up data samples recorded during the set-up measurement for a plurality of set-up sample times, the prediction model M is determined (at 105) using a machine learning method, e.g., using a neural network like a 2-layer feedforward Perceptron. The prediction model M establishes a connection between the input parameters and the actual PCV pressure $p_{act}$. As a rule, the set-up measurement(s) and the determination of the prediction model M are not performed by the diagnosis unit 20, but by a set-up unit (not shown) that is not part of the vehicle. The set-up unit may comprise a desktop computer or a big data processing computer and its computing power is normally considerably greater than the computing power of the diagnosis unit 20. When the prediction model M has been determined, it can be transferred to the diagnosis unit 20.

Since the diagnosis of the PCV line 10 depends on an accurate measurement of the actual PCV pressure $p_{act}$, the first pressure sensor 12 is calibrated at 110 before the diagnosis starts. Calibration can be performed when the engine 2 is off so that the actual PCV pressure $p_{act}$ should correspond to an atmospheric pressure $p_{atm}$ in the vicinity of the engine system 1. Then, at 115, at least one diagnosis measurement is performed on the engine system 1 during a measurement period, which may take several minutes or even hours.

During the diagnosis measurement, the input parameters $n_e$, $p_{int}$, Q and the actual PCV pressure pa are determined repeatedly. Thus, a plurality of data samples is obtained, each of which is associated with a corresponding sample time $t_s$. The data samples are stored in a memory device of the diagnosis unit 20. After completion of the diagnosis measurements, in step 120, a low-pass filter is applied to one or several input parameters $n_e$, $p_{int}$, Q. In particular, such a low-pass filter may be applied to the intake pressure $p_{int}$, thereby eliminating high-frequency components. It should be noted that an equivalent low-pass filter is usually applied to one or several input parameters $n_e$, $p_{int}$, Q that are measured during the set-up measurement(s) at step 100 before the prediction model M is determined at step 105. At step 125, the diagnosis unit 20 uses the prediction model M to determine a predicted PCV pressure $p_{pre}$ based on the input parameters $n_e$, $p_{int}$, Q that have been measured during the diagnosis measurement.

Afterwards, the method proceeds with a comparison section 130, that is based on a comparison of the predicted PCV pressure $p_{pre}$ and the actual PCV pressure $p_{act}$. In step 135, a model error $p_{err}$ is determined, which is defined as the difference between the predicted PCV pressure $p_{pre}$ and the actual PCV pressure $p_{act}$. It will be noted that the model error has the dimension of a pressure and depends on the sample time $t_s$, i.e. the model error $p_{err}$ generally has different values for different sample times $t_s$. In step 140, a low-pass filter is applied to the model error $p_{err}$ to eliminate high-frequency components.

At step 145, a first sample time $t_s$ is selected, which normally corresponds to the beginning of the measurement period. At step 150, several enabling conditions are checked for this sample time $t_s$. A first enabling condition is whether the difference between the intake pressure $p_{int}$ and the atmospheric pressure $p_{atm}$ is above a predefined minimum pressure, e.g., 0.15 bar. A second enabling condition is whether the engine speed $n_e$ is above a predefined minimum speed, e.g., 2500 rpm. A third enabling condition is whether the intake gas flow Q is above a predefined minimum flow. A fourth enabling condition is whether the atmospheric pressure $p_{atm}$ is above a predefined minimum pressure. Also, if a transient period is identified for one of the input parameters $n_e$, $p_{int}$, Q, in particular for the intake pressure $p_{int}$, another enabling condition may be that a first delay time (of e.g. 700 ms) has passed since the end of the transient period. Furthermore, any of the above-mentioned enabling conditions may not only be checked for the respective sample time $t_s$, but also within a second delay time, of e.g. 800 ms, before this sample time $t_s$. In this case, the enabling conditions have to be fulfilled for every sample time $t_s$, starting from 800 ms before the sample time $t_s$ that is currently checked.

If any of the enabling conditions is not fulfilled, the actual PCV pressure $p_{act}$ and the model error $p_{err}$ for this sample time $t_s$ are ignored and the method continues at step 180, were this checked whether the current sample time $t_s$ was the last sample time $t_s$. If not, the method selects the next sample time $t_s$ at step 185 and returns to step 150. If all enabling conditions are fulfilled, the model error $p_{err}$ is compared in step 155 with a lower threshold $p_{lt}$. If the model error $p_{err}$ is below this lower threshold $p_{lt}$, this is used in step 160 as an indication that the PCV line 10 is intact. However, this is not the final diagnosis result, but only an indication gained from the data for this specific sample time $t_s$. If the model error $p_{err}$ is not below the lower threshold $p_{lt}$, it is checked at step 165 if the model error $p_{err}$ is above an upper threshold $p_{lt}$. If so, this is used at step 170 as an indication that the PCV line 10 is damaged. If not, i.e., if the model error $p_{err}$ is between the two thresholds $p_{lt}$, $p_{ut}$, this is interpreted at step 175 as an inconclusive result. After each of the steps 160, 170 and 175, the method continues with step 180. Accordingly, all sample times $t_s$ are processed sequentially. Afterwards, at step 190, a diagnosis result is determined.

Figure 3:
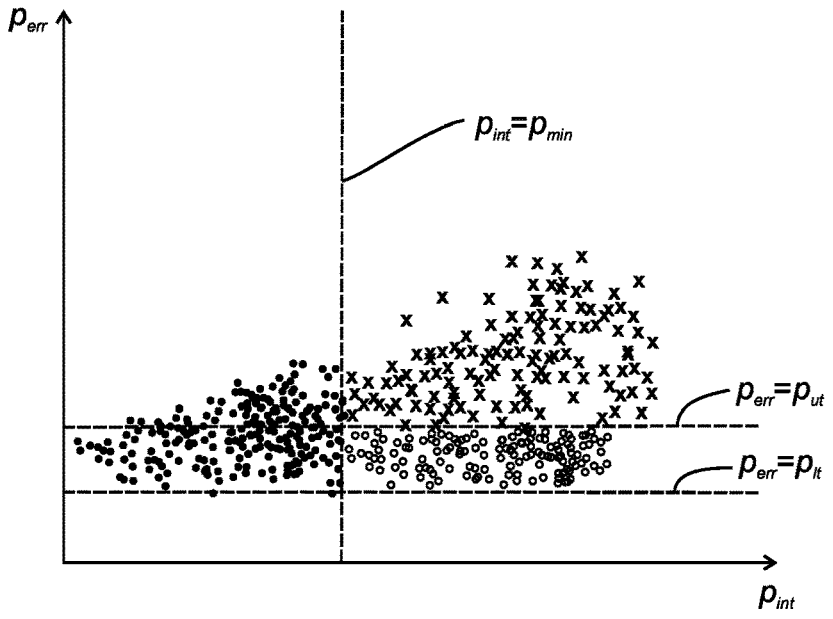
FIG. 3 is a first diagram showing a model error versus an intake pressure.
Figure 4:
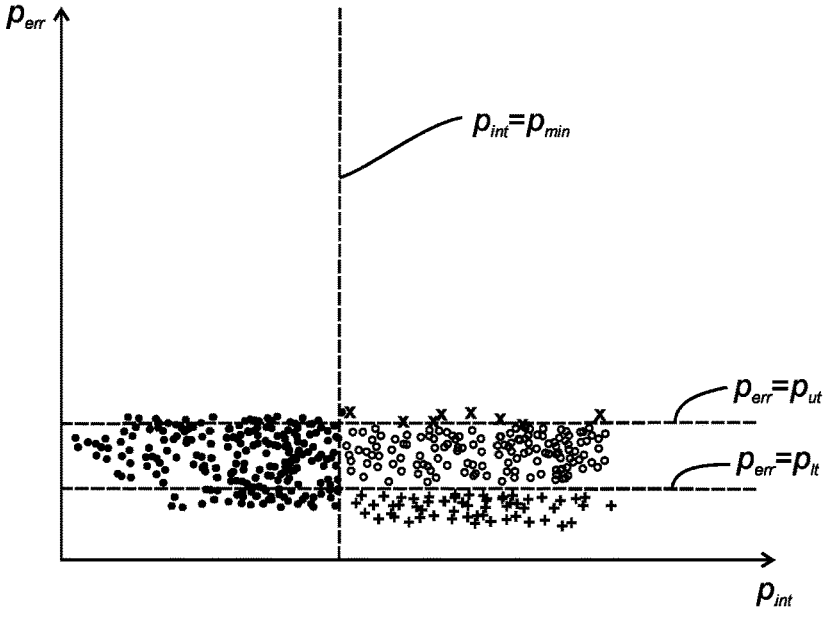
FIG. 4 is a second diagram showing the model error versus the intake pressure.

FIGS. 3 and 4 illustrate, by way of example, the model error $p_{err}$ versus the intake pressure $p_{int}$. FIG. 3 represents an engine system 1 with a damaged PCV line 10. A vertical dashed line represents the enabling condition according to which the intake pressure $p_{int}$ has to be above a predefined minimum pressure $p_{min}$. Any samples not fulfilling this enabling condition, shown as full circles, are disregarded. A portion of the remaining samples, shown as empty circles, represent a model error between the two thresholds $p_{lt}$, $p_{ut}$, while another portion, shown as "x" 's, represent a model error above the upper threshold $p_{ut}$. In this case, a large number of samples that fulfil the enabling condition are above the upper threshold $p_{ut}$, while no samples are below the lower threshold $p_{lt}$. In this case, the diagnosis result at step 190 is that the PCV line is damaged, i.e., that it either has a small leak or is completely disconnected.

In the diagram of FIG. 4, which represents an intact PCV line, there is also a considerable portion of data samples which do not fulfill the enabling condition. A large number of data samples represent a model error $p_{err}$ that is between the two thresholds $p_{lt}$, $p_{ut}$ and therefore does not allow for any conclusion. A very small first number of data samples is above the upper threshold $p_{ut}$, while a considerably larger second number of data samples, represented by crosses, is below the lower threshold $p_{lt}$. The diagnosis is then based on a comparison of the first number with the second number. In this case, although there are some data symbols above the upper threshold $p_{ut}$, indicating a damaged PCV line, it will be concluded at step 190 that the PCV line is intact, due to the much higher (second) number of data samples below the lower threshold pr.

LEGEND OF REFERENCE NUMBERS

1 engine system
2 engine
3 combustion chamber
4 crankcase
5 intake duct
6 exhaust duct
7 compressor
8 cooler
9 throttle
10 PCV line
11 non-return valve
12, 13 pressure sensor
20 diagnosis unit

The invention claimed is:

1. A method for positive crankcase ventilation diagnosis in an engine system comprising an internal combustion engine, an intake duct connected to the engine, a PCV line connecting a crankcase of the engine with the intake duct and a sensor for determining an actual PCV pressure ($p_{act}$) in the PCV line, the method comprising the steps of:

performing a diagnosis measurement during a measurement period by repeatedly determining at least one input parameter ($p_{int}$, $n_e$, $p_{atm}$, Q), which is linked to the operation of the engine system, and the actual PCV pressure ($p_{act}$), to obtain a plurality of data samples for a plurality of sample times ($t_s$);

using a prediction model (M) to determine a predicted PCV pressure ($p_{pre}$) based on the determined at least one input parameter ($p_{int}$, $n_e$, $p_{atm}$, Q); and comparing the actual PCV pressure ($p_{act}$) with the predicted PCV pressure ($p_{pre}$) to diagnose the PCV line, wherein a diagnosis of the PCV line is based on a model error ($p_{err}$), which is the difference between the predicted PCV pressure ($p_{pre}$) and the actual PCV pressure ($p_{act}$), wherein the model error ($p_{err}$) being below a lower threshold ($p_{lt}$) is considered to indicate that the PCV line is intact, the model error ($p_{err}$) being above an upper threshold ($p_{ut}$) is considered to indicate that the PCV line is damaged, and the model error ($p_{err}$) being between the lower threshold ($p_{lt}$) and the upper threshold ($p_{ut}$) is considered as an inconclusive result.

2. The method according to claim 1, wherein the diagnosis is based on a comparison between a first number of sample times ($t_s$) with a model error ($p_{err}$) indicating that the PCV line is intact and a second number of sample times ($t_s$) with a model error ($p_{err}$) indicating that the PCV line is damaged.

3. The method according to claim 1, comprising, before the diagnosis measurement, performing at least one set-up measurement by determining the actual PCV pressure ($p_{act}$) and the at least one input parameter ($p_{int}$, $n_e$, $p_{atm}$, Q) in an intact engine system; and determining the prediction model (M) at least partially based on the at least one set-up measurement.

4. The method according to claim 3, wherein the at least one set-up measurement is performed during a set-up period by repeatedly determining the actual PCV pressure ($p_{act}$) and the at least one input parameter ($p_{int}$, $n_e$, $p_{atm}$, Q) in an intact engine system, to obtain a plurality of set-up data samples for a plurality of set-up sample times.

5. The method according to claim 1, wherein the at least one input parameter ($p_{int}$, $n_e$, $p_{atm}$, Q) changes during at least one set-up measurement.

6. The method according to claim 1, wherein the prediction model (M) is determined based on a neural network trained with set-up data samples corresponding to at least one set-up measurement, in which the actual PCV pressure ($p_{act}$) and the at least one input parameter ($p_{int}$, $n_e$, $p_{atm}$, Q) in an intact engine system have been determined.

7. The method according to claim 1, wherein a calibration is performed for the actual PCV pressure ($p_{act}$).

8. The method according to claim 1, wherein the at least one input parameter is selected from among an engine speed ($n_e$), an intake pressure ($p_{int}$), an intake gas flow (Q), an atmospheric pressure ($p_{atm}$), a coolant temperature of a cooling system of the engine, and a throttle position of a throttle in the intake duct.

9. The method according to claim 1, wherein an actual PCV pressure ($p_{act}$) of a sample time ($t_s$) in the measurement period is only used for the diagnosis if at least one enabling condition is fulfilled for this sample time ($t_s$), and is disregarded otherwise.

10. The method according to claim 9, wherein the at least one enabling condition is that the engine speed ($n_e$) is above a predefined minimum speed, the difference between the intake pressure ($p_{int}$) and atmospheric pressure is above a predefined minimum pressure, the intake gas flow (Q) is above a predefined minimum flow and/or the atmospheric pressure ($p_{atm}$) is above a predefined minimum pressure.

11. The method according to claim 9, wherein one enabling condition is that a predefined first delay time has passed since a transient period of the at least one input parameter ($p_{int}$, $n_e$, $p_{atm}$, Q).

12. The method according to claim 9, wherein the actual PCV pressure ($p_{act}$) is only used if the at least one enabling condition has been fulfilled for a predefined second delay time before the sample time ($t_s$).

13. The method according to claim 1, wherein a low-pass filter is applied to the at least one input parameter ($p_{int}$, $n_e$, $p_{atm}$, Q).

14. The method according to claim 1, wherein a low-pass filter is applied to the model error ($p_{err}$) before the diagnosis.

15. A diagnosis unit for positive crankcase ventilation diagnosis in an engine system comprising an engine, an intake duct connected to the engine, a PCV line connecting a crankcase of the engine with the intake duct and a sensor for determining an actual PCV pressure (pact) in the PCV line, the diagnosis unit being configured to:

perform a diagnosis measurement during a measurement period by repeatedly determining at least one input parameter ($p_{int}$, $n_e$, $p_{atm}$, Q), which is linked to the operation of the engine system, and the actual PCV pressure ($p_{act}$), to obtain a plurality of data samples for a plurality of sample times ($t_s$);

use a prediction model (M) to determine a predicted PCV pressure ($p_{pre}$) based on the determined at least one input parameter ($p_{int}$, $n_e$, $p_{atm}$, Q); and compare the actual PCV pressure ($p_{act}$) with the predicted PCV pressure ($p_{pre}$) to diagnose the PCV line, wherein a diagnosis of the PCV line is based on a model error ($p_{err}$), which is the difference between the predicted PCV pressure ($p_{pre}$) and the actual PCV pressure ($p_{act}$), wherein the model error ($p_{err}$) being below a lower threshold ($p_{lt}$) is considered to indicate that the PCV line is intact, the model error ($p_{err}$) being above an upper threshold ($p_{ut}$) is considered to indicate that the PCV line is damaged, and the model error ($p_{err}$) being between the lower threshold ($p_{lt}$) and the upper threshold ($p_{ut}$) is considered as an inconclusive result.

* * * * *